US007644001B2

(12) United States Patent
Schuijers et al.

(10) Patent No.: US 7,644,001 B2
(45) Date of Patent: Jan. 5, 2010

(54) DIFFERENTIALLY CODING AN AUDIO SIGNAL

(75) Inventors: Erik Gosuinus Petrus Schuijers, Eindhoven (NL); Arnoldus Werner Johannes Oomen, Eindhoven (NL); Matheus Johannes Antonius Mans, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 886 days.

(21) Appl. No.: 10/536,243

(22) PCT Filed: Oct. 31, 2003

(86) PCT No.: PCT/IB03/04864

§ 371 (c)(1),
(2), (4) Date: May 24, 2005

(87) PCT Pub. No.: WO2004/049309

PCT Pub. Date: Jun. 10, 2004

(65) Prior Publication Data

US 2006/0147047 A1 Jul. 6, 2006

(30) Foreign Application Priority Data

Nov. 28, 2002 (EP) ..... 02080008

(51) Int. Cl.
*G10L 19/00* (2006.01)

(52) U.S. Cl. ..... 704/500; 704/E19.005

(58) Field of Classification Search ..... 704/500, 704/E19.005

See application file for complete search history.

(56) References Cited

U.S. PATENT DOCUMENTS 6,029,126 A * 2/2000 Malvar ..... 704/204
6,446,037 B1 * 9/2002 Fielder et al. ..... 704/229
6,629,078 B1 * 9/2003 Grill et al. ..... 704/500

FOREIGN PATENT DOCUMENTS

EP 1107232 A2 6/2001
WO 03090207 A1 10/2003

OTHER PUBLICATIONS

T. S. Verma and T. H. Y. Meng, "A 6 kbps to 85 kbps scalable audio coder," Proc. IEEE Int. Conf. Acoust., Speech, Signal Processing, pp. 877-880, 2000.*

M. Paraskevas and J. Mourjopoulos, "A differential perceptual audio coding method with reduced bitrate requirements," IEEE Trans. Speech Audio Processing, pp. 490-503, Nov. 1995.*

(Continued)

*Primary Examiner*—Talivaldis I Smits
*Assistant Examiner*—Greg A Borsetti

(57) ABSTRACT

Coding an audio signal wherein values of first parameters, which represent aspects of the audio signal at a first instant are calculated to obtain first calculated values and values of second parameters, which represent the aspects of the audio signal at a second, later, instant, are calculated to obtain second calculated values, wherein the number of the first parameters and the number of the second parameters differ. The values of the subset of the second parameters are coded based on a difference of this subset and a subset of the first calculated value associated with substantially a same particular portion of the frequency range. Thus the differentially coded values of the second parameters are obtained by coding the difference of the values of second parameters and first parameters which are associated with substantially the same frequency sub-range.

13 Claims, 4 Drawing Sheets

OTHER PUBLICATIONS

Figure 1:
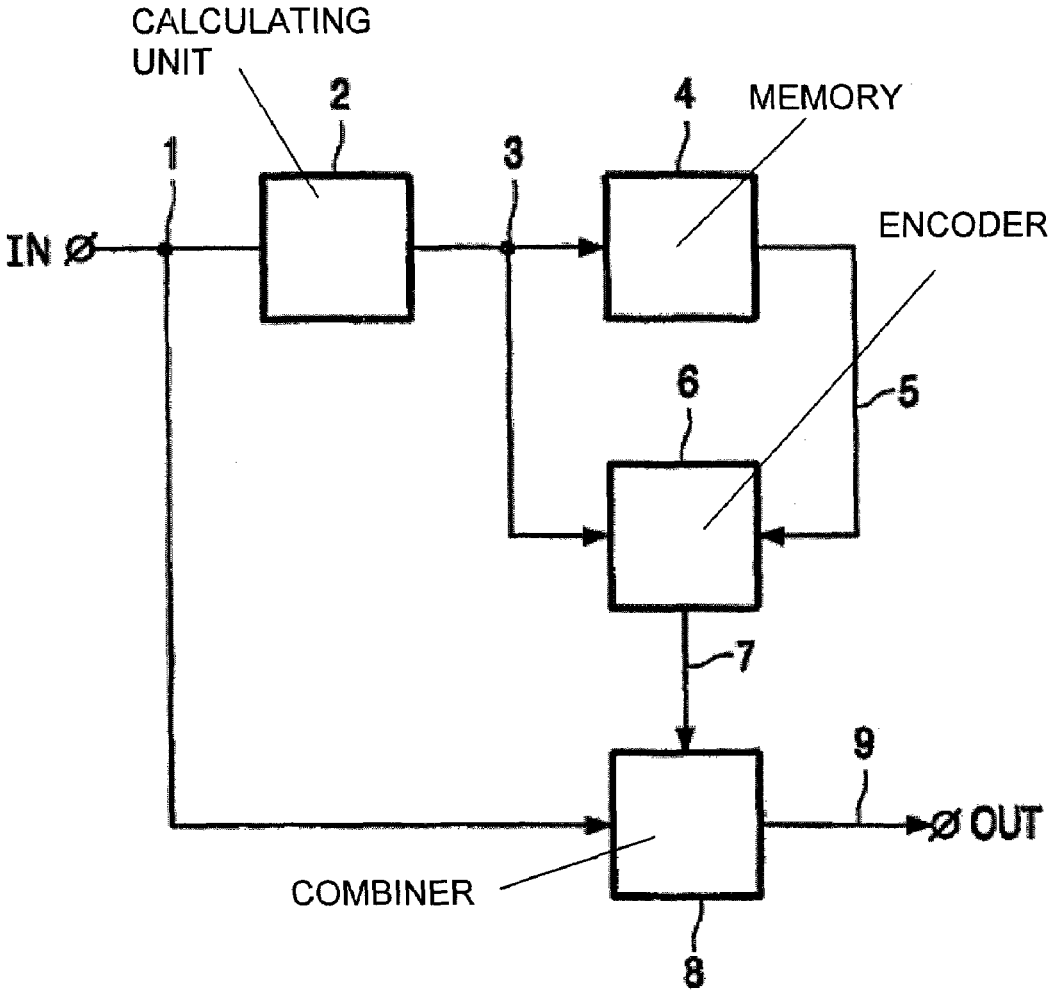

B. Edler and H. Purnhagen, "Parametric audio coding," in Proc. 5th Int. Conf. Signal Processing (ICSP 2000) Beijing, China, Aug. 2000.*

Faller C. et al; Binaural Cue Coding Applied to Stereo and Multi-Channel Audio Compression, May 2002, XP09024737.

Jasper Jensen, et al; Optimal Time-Differential Encoding of Sinusoidal Model Parameters, May 2001, pp. 1-8, XP002224268.

Edler B. et al; ASAC—Analysis/Synthesis Audio Codec for Very Low Bit Rates, May 1996, pp. 1-15, XP001062332.

E. G. P. Schuijers, et al; Advances in Parametric Coding for High-Quality Audio, IEEE, MPCA, Nov. 2002.

* cited by examiner

DIFFERENTIALLY CODING AN AUDIO SIGNAL

The invention relates to a method of coding an audio signal, an encoder for coding an audio signal, and an apparatus for supplying an audio signal.

Prior solutions in audio coders that have been suggested to reduce the bit rate of stereo program material include intensity stereo and M/S stereo.

In the intensity stereo algorithm, high frequencies (typically above 5 kHz) are represented by a single audio signal (i.e., mono) combined with time-varying and frequency-dependent scale factors or intensity factors which allow to recover a decoded audio signal which resembles the original stereo signal for these frequency regions.

In the M/S algorithm, the signal is decomposed into a sum (or mid, or common) signal and a difference (or side, or uncommon) signal. This decomposition is sometimes combined with principle component analysis or time-varying scale factors. These signals are then coded independently, either by a transform-coder or sub-band-coder (which are both waveform-coders). The amount of information reduction achieved by this algorithm strongly depends on the spatial properties of the source signal. For example, if the source signal is monaural, the difference signal is zero and can be discarded. However, if the correlation of the left and right audio signals is low (which is often the case for the higher frequency regions), this scheme offers only little bit rate reduction. For the lower frequency regions M/S coding generally provides significant merit.

Parametric descriptions of audio signals have gained interest during the last years, especially in the field of audio coding. It has been shown that transmitting (quantized) parameters that describe audio signals requires only little transmission capacity to re-synthesize a perceptually substantially equal signal at the receiving end. One type of parametric audio coders focuses on coding monaural signals, and stereo signals are processed as dual mono signals.

Another type of parametric audio coders is disclosed in EP-A-1107232. This parametric audio encoder uses a parametric coding scheme to generate a representation of a stereo audio signal which is composed of a left channel signal and a right channel signal. To efficiently utilize transmission bandwidth, such a representation contains information concerning only a monaural signal which is a combination of the left channel signal and the right channel signal, and parametric information. The stereo signal can be recovered based on the monaural signal together with the parametric information. The parametric information comprises localization cues of the stereo audio signal, including intensity and phase characteristics of the left and the right channel.

The parametric information is represented by parameters which characterize aspects of the audio signal in a frequency range of the audio signal for which the parameter is determined. The coded audio signal may comprise the coded monaural audio signal and a single global parameter (or a set of global parameters) which are determined for the complete bandwidth or frequency range of the audio signal to be coded, and/or one or more local parameters (or sets of local parameters) which are determined for corresponding sub-ranges of the frequency range of the audio signal (these sub-ranges of the frequency range are also referred to as bins).

Many audio coding schemes employ parameters of which the amount varies over time, for example, in waveform-coders like MPEG-1 Layer-III (mp3), AAC (Advanced Audio Coding), the number of MDCT (modified discrete cosine transfer) coefficients can vary over time.

The not yet published European patent application no. 2002 02076588.9 discloses that the number of frequency sub-ranges (also referred to as bins) used for the parametric stereo representation can change from frame to frame.

The not yet published European patent application no. 2002 0277869.2 discloses that the corresponding parameters of successive frames can be encoded differentially over time. In this manner, the redundancy in the time direction can be removed. The number of parameters is identical in successive frames.

In E. G. P Schuijers, et.al, "Advances in Parametric coding for high-quality audio", presented at 1st IEEE Benelux Workshop on Model based Processing and Coding of Audio (MPCA 2002), Leuven Belgium, Nov. 15, 2002, a parametric coding scheme is described that has been extended with a parametric stereo description. This description tries to model the binaural cues by means of three parameters: Inter-channel Intensity Differences (IID), Inter-channel Time Differences (ITD) and Inter-channel Cross Correlation (ICC). These parameters are estimated on a non-uniform frequency grid resembling the human auditory system. The number of frequency bins on this grid is typically 20. In the European patent application no. 2002 02077869.2 a scalable approach for the coding of these parameters has been proposed.

For this parametric coding scheme also the possibility exists to change the number of the LPC (linear Predictive Coding) coefficients used to describe the spectral envelope from frame to frame.

A first aspect of the invention provides a method of coding an audio signal. A second aspect of the invention provides an encoder for coding an audio signal. A third aspect of the invention provides an apparatus for supplying an audio signal. Advantageous embodiments are defined in the dependent claims.

In the method in accordance with the first aspect of the invention, differential coding is performed when the number of parameters is different in successive frames. This provides a more efficient coding of the parameters and thus less bandwidth will be required for the coded parameters.

In the method of coding the audio signal, the values of the first parameters, which represent aspects of the audio signal at a first instant, are calculated to obtain the first calculated values. The values of second parameters, which represent the aspects of the audio signal at a second, later, instant, are calculated to obtain the second calculated values. The number of the first parameters and the number of the second parameters differ. A subset of the second parameters is associated with a particular portion of a frequency range of the audio signal. The values of the subset of the second parameters are coded based on a difference of this subset and a subset of the first calculated value(s) associated with substantially this same particular portion of the frequency range.

This allows to differential code the parameters even if the number of parameters changes over time.

In an embodiment, within a particular frequency sub-range or bin, a single parameter has to be calculated for use in the first frame at the first instant. Within substantially this same frequency sub-range, several parameters have to be calculated for use in the second frame at the second instant. Each one of the several parameters for use in the second frame is differentially coded based on its difference with respect to the value of the single parameter.

If the frequency sub-ranges are not identical in that one of the several parameters is associated with a frequency sub-range which is not completely covered by the particular frequency sub-range, a correction may be applied in that this parameter is coded with respect to both the single parameter and a parameter associated with the frequency range not covered by the single parameter.

In an embodiment, within a particular frequency sub-range or bin, several parameters have to be calculated for use in the first frame at the first instant. Within substantially this same frequency sub-range a single parameter has to be calculated for use in the second frame at the second instant. The value of the single parameter is differentially coded with respect to the mean value of the several parameters.

In an embodiment, the mean value is calculated as a weighted sum of the values of the several parameters.

In an embodiment, all the weights are equal to one divided by the number of the several parameters of the first frame which correspond with the single parameter of the second frame.

In an embodiment, the weights are selected for each one of the several parameters to correspond to the size of the corresponding frequency sub-range.

In an embodiment, the frequency sub-ranges are not identical in that the frequency sub-range of the single parameter only partly covers the frequency range of one of the several parameters, the contribution to the mean value of the value of this one parameter is less than the other ones of the several parameters. Preferably, its contribution depends on the percentage of the frequency range of the several parameters covered by the frequency sub-range of the single parameter only partly covering the frequency range of the several parameters.

In an embodiment, the audio signal is coded by different sets of parameters. Global parameters are calculated for the total frequency range of the audio signal. These global parameters allow decoding the audio signal with a basic (lower) quality. To allow an improved quality of the decoded audio signal, supplemental parameters may be coded. The number of these supplemental parameters may change over time. The number of the first parameters which are required during a first frame is smaller than the number of second parameters required during a successive second frame. Each one of the first parameters and the corresponding one of the second parameters cover substantially the same frequency sub-range. In frequency sub-ranges wherein a second parameter value has to be coded, this parameter value is differentially coded with respect to the value of the corresponding first parameter which is associated with substantially the same frequency sub-range. In frequency ranges for which a second parameter has to be coded but no corresponding first parameter value is available, the value of the second parameter is coded differentially with respect to the global value(s).

In an embodiment, the audio signal is coded by different sets of parameters. Global parameters are calculated for the total frequency range of the audio signal. These global parameters allow decoding the audio signal with a basic (lower) quality. To allow an improved quality of the decoded audio signal, supplemental parameters may be coded. The amount of these supplemental parameters may change over time. The number of the first parameters which is required during a first frame is larger than the number of second parameters required during a successive second frame. Each one of the first parameters and the corresponding one of the second parameters cover substantially the same frequency sub-range. In frequency sub-ranges wherein a second parameter value has to be coded, this parameter value is differentially coded with respect to the value of the corresponding first parameter which is associated with substantially the same frequency sub-range. In frequency ranges for which a first parameter value is available but no corresponding second parameter has to be coded, nothing has to happen.

These and other aspects of the invention are apparent from and will be elucidated with reference to the embodiments described hereinafter.

Figure 2:
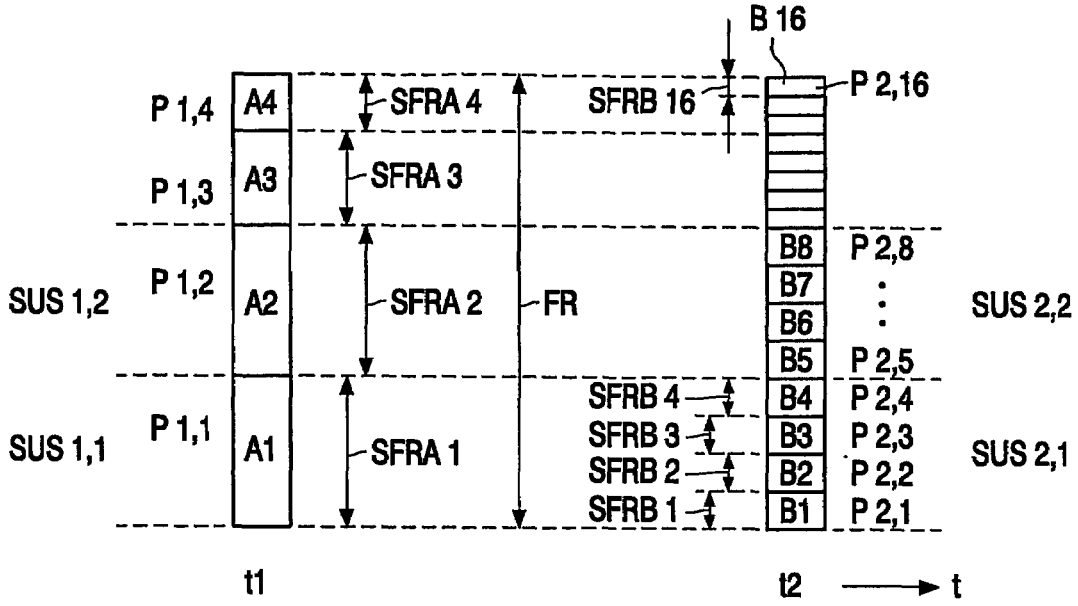
Figure 3:
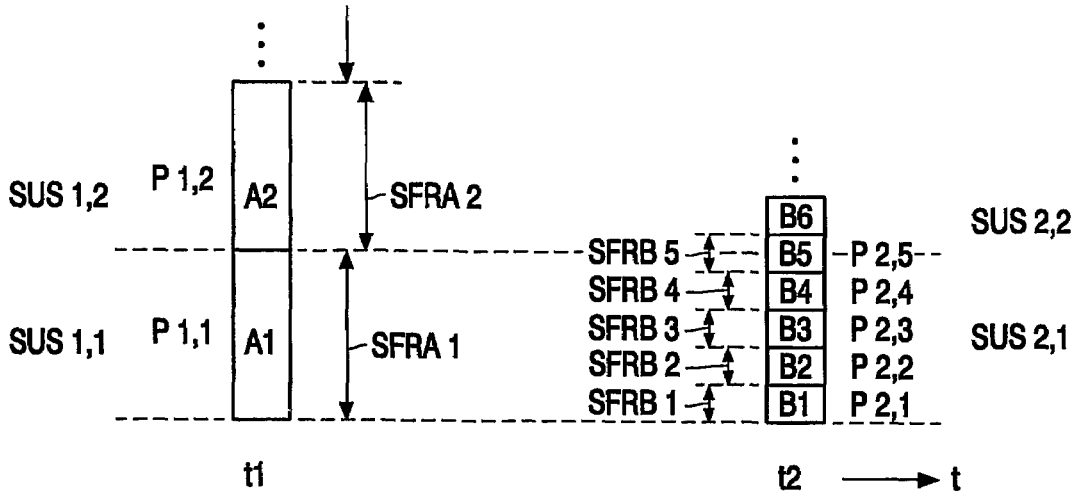
Figure 4:
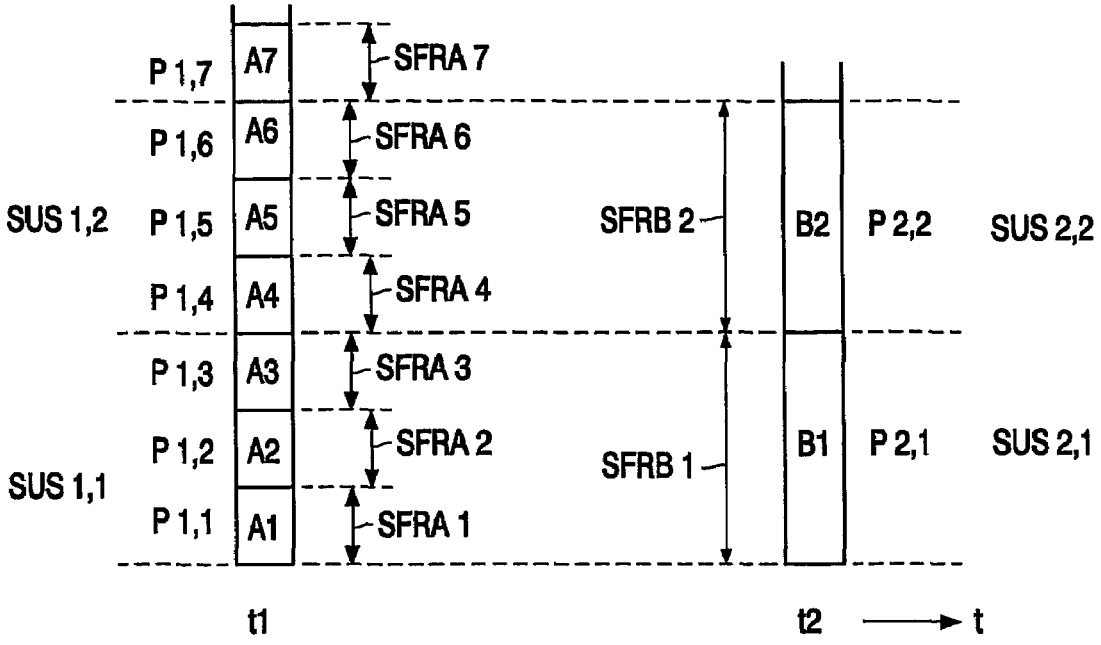
Figure 5:
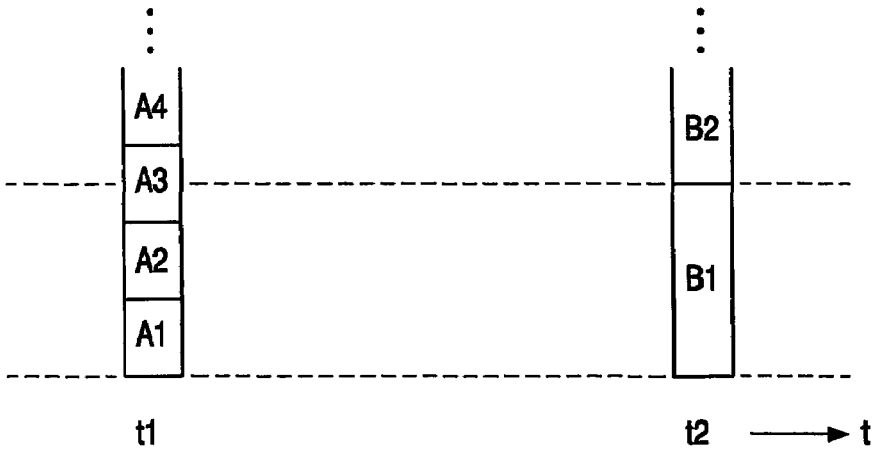
Figure 6:
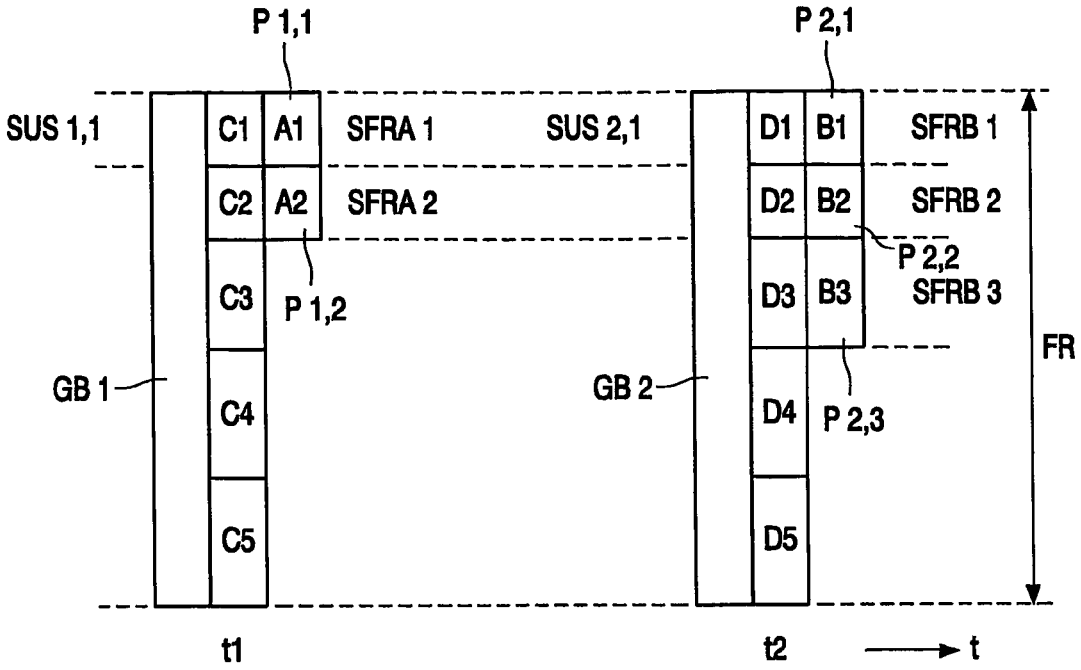
Figure 7:
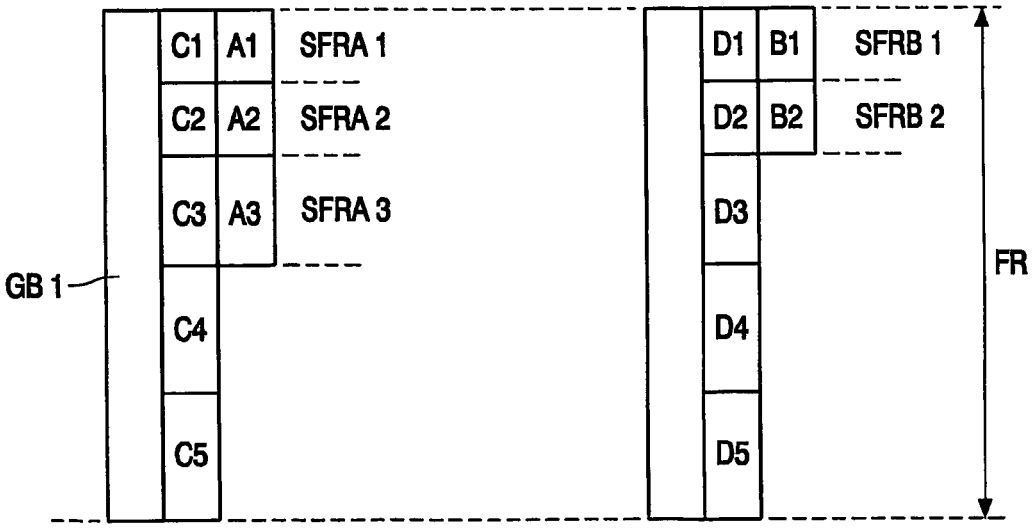

In the drawings:

FIG. 1 shows a block diagram of an encoder in accordance with an embodiment of the invention, FIG. 2 shows a schematic representation of a situation wherein the number of parameters during a first frame is less than during a second frame, FIG. 3 shows another schematic representation of a situation wherein the number of parameters during a first frame is less than during a second frame, FIG. 4 shows a schematic representation of a situation wherein the number of parameters during a first frame is higher than during a second frame, FIG. 5 shows another schematic representation of a situation wherein the number of parameters during a first frame is higher than during a second frame, FIG. 6 shows a schematic representation of a situation wherein the number of parameters during a first frame is less than during a second frame, and FIG. 7 shows a schematic representation of a situation wherein the number of parameters during a first frame is higher than during a second frame.

The same references in different Figs. refer to the same signals or to the same elements performing the same function.

FIG. 1 shows a block diagram of an encoder in accordance with an embodiment of the invention. An input IN receives an audio signal 1. The audio signal 1 has to be coded in such a way that a data-reduction is achieved. Data reduction is possible by representing certain aspects of the audio signal by parameters. These parameters define a certain aspect of the audio signal 1 within a particular frequency range of the audio signal 1. The particular frequency range of the audio signal 1 may cover all frequencies present in the audio signal 1, or may be a sub-range of the frequencies present in the audio signal 1. The parameters have to be determined regularly in time to be able to represent the changing audio signal 1. Usually, the parameters are determined and coded at regular time intervals called frames. The exact way the audio signal 1 is represented by the parameters, and the parameters are coded is not important to the invention, many known approaches may be implemented. The invention is directed to the fact that the parameters are differentially coded, even when the number of parameters to be coded differs over successive frames.

A calculating unit 2 receives the audio signal 1 and supplies calculated values 3 every frame. The calculated values 3 represent parameters which should be differentially coded. The coded values should be available in a particular frame. A memory 4 stores the calculated values 3 every frame and supplies the stored values 5. The encoder 6 codes the difference of the calculated values 3 of a present frame and the stored values 5 of the preceding frame and supplies the differentially coded parameter values 7. The differentially coded parameter values 7 may be combined with a coded monaural audio signal in the unit 8 to supply a coded audio signal 9 at the output OUT.

The encoder may contain dedicated hardware or may be a suitably programmed processor which performs the calculations and the other steps.

FIG. 2 shows a schematic representation of a situation wherein the number of parameters during a first frame t1 is less than during a second frame t2. The parameters P1,1 to P1,4 (further referred to as P1,i) and their associated frequency sub-ranges SFRA1 to SFRA4 (further referred to as SFRAi) are shown at the left side for a first frame t1. The parameters P2,1 to P2,16 (further referred to as P2,i) and their associated frequency sub-ranges SFRB1 to SFRB16 (further referred to as SFRBi) are shown the at the right side for a second frame t2 succeeding the first frame t1.

The parameter P1,i has a calculated value Ai, and the parameter P2,i has a calculated value Bi. A specific one of the parameters P1,i or P2,i is obtained by substituting a number for the index i.

The total frequency range is indicated by FR. The subsets of the first calculated value(s) SUS1,i, each comprise a single calculated value A1,i. The subsets of the second calculated value(s) SUS2,i, each comprise more than one (4 in the example shown in FIG. 2) calculated values A2,i.

Consequently, in the associated subsets SUS1,i and SUS2,i, which correspond to the same frequency sub-range SFRAi, always four second calculated value(s) Bi, correspond to one first calculated value(s) Ai. Each one of the four second calculated value(s) Bi, is coded differentially with respect to the same one first calculated value(s) Ai. This means that each of the four coded values is equal to the corresponding second calculated value(s) Bi minus the first calculated value(s) Ai.

FIG. 3 shows another schematic representation of a situation wherein the number of parameters during a first frame is less than during a second frame. In contrast to FIG. 2 now the frequency sub-range obtained by combining the frequency sub-ranges SFRB1 to SFRB4 together is not identical to the frequency range SFRA1 but slightly smaller. The frequency sub-range SFRB5 occurs partly within the frequency range SFRA1 and partly within the frequency range SFRA2. The coded values of the parameters P2,1 to P2,4 are coded differentially with respect to the value A1 of the parameter P1,1. The coded value of the parameter P2,5 may be coded differentially with respect to either the value A1 or the value A2 of the parameter P1,2. It is also possible to code the value of the parameter P2,5 as the difference of the value B5 and a weighted sum of the values A1 and A2. Preferably, the values A1 and A2 are weighted in accordance with the overlap of the frequency range SFRB5 with the frequency ranges SFRA1 and SFRA2, respectively.

FIG. 4 shows a schematic representation of a situation wherein the number of parameters during a first frame is higher than during a second frame. FIG. 4 shows a similar situation as shown in FIG. 2 but now the frame t1 has a larger number of parameters P1,i than the succeeding frame t2.

The parameters P2,1 and P2,2 (further referred to as P2,i) and their associated frequency sub-ranges SFRB1 and SFRB2 (further referred to as SFRBi) are shown at the right side for the second frame t2. The parameters P1,1 to P1,7 (further referred to as P1,i) and their associated frequency sub-ranges SFRA1 to SFRA7 (further referred to as SFRAi) are shown the at the left side for the first frame t1.

The parameter P1,i has a calculated value Ai, and the parameter P2,i has a calculated value Bi. A specific one of the parameters P1,i or P2,i is obtained by substituting a number for the index i.

The subsets of the second calculated value(s) SUS2,i, each comprise a single calculated value Bi. The subsets of the first calculated value(s) SUS1,i, each comprise more than one (3 in the example shown in FIG. 4) calculated values Ai.

Consequently, in the associated subsets SUS1,i and SUS2,i, which correspond to the same frequency sub-range SFRBi, always one second calculated value(s) Bi corresponds to three first calculated value(s) Ai.

The second calculated value Bi is differentially coded with respect to a calculated weighted mean of the group of associated calculated values Ai. The values Ai are associated with the value Bi if they belong to parameters P1,i which belong to a frequency sub-range SFRAi which occurs within or at least partly overlaps with the frequency range SFRBi.

The weighted mean is calculated as:

$$V_{gropup} = \sum_{i=1}^{M} q_i V_i$$

wherein Vgroup represents a group parameter value, M is the number of parameters belonging to the group of associated calculated values Ai, and qi are the weight functions for which the following holds:

$$\sum_{i=1}^{M} q_i = 1.$$

For example, the weights qi are selected to be 1/M, but also the size of the frequency sub-range or bin that a certain parameter belongs to is a good choice.

FIG. 5 shows another schematic representation of a situation wherein the number of parameters during a first frame is higher than during a second frame.

In the example of FIG. 4, the bins belonging to a group in frame t1 always fully fall within a single bin of frame t2. This is not the case in FIG. 5, the bin associated with the value A3 is only partly within the bin associated with the value B1. In differentially coding the value B1 with respect to the weighted value, the weights for the value A3 may be selected smaller. Preferably, the decrease of this weight is related to the part of the bin of A3 which is within the bin of B1 as a percentage of the bins of A1 and A2 which are completely within the bin B1.

For example, the differential coding as shown in FIGS. 2 to 5 is relevant in the parametric coding scheme as presented in E. G. P Schuijers, et.al, "Advances in Parametric coding for high-quality audio", presented at 1st IEEE Benelux Workshop on Model based Processing and Coding of Audio (MPCA 2002), Leuven Belgium, Nov. 15, 2002, wherein, because of the quality/bit-rate trade-off, the number of bins used for the IID/ITD/ICC parameters may switch to 10 or 40 frequency bins instead of the typical 20.

FIG. 6 shows a schematic representation of a situation wherein the number of parameters during a first frame is less than during a second frame.

FIGS. 2 to 5 showed a variable number of (sets of) parameters P1,i and P2,i which correspond to a certain fixed frequency region SF. Consequently, if the number of parameters changes, the size of frequency sub-ranges SFRAi or SFRBi will change accordingly such that all the frequency sub-ranges SFRAi or SFRBi together cover the fixed frequency region SF.

Alternatively, as shown in FIGS. 6 and 7, each parameter P1,i and P2,i may belong to a certain frequency region SFRAi and SFRBi, respectively, i.e. the frequency region SFRAi or SFRBi a specific parameter P1,i or P2,i applies to is constant. If the number of parameters P1,i and P2,i in a frame t1 or t2 changes, the total size of the frequency range covered by all frequency regions SFRAi or SFRBi together changes. This may be the case for the ITD parameter.

In the frame t1, the left most column indicates the global parameter(s) GB1 which represent aspects of the audio signal 1 for the total frequency range FR. The adjacent column shows five parameters (or sets of parameters, for example IID and/or ICC parameters) which are indicated by C1 to C5. Each one of the parameters (or parameter sets) Ci is relevant for an associated frequency sub-range of the total frequency range FR. The frequency sub-ranges together cover the total frequency range FR. The right most column in the frame t1 shows two frequency sub-ranges SFRA1 and SFRA2 in which two parameters (or sets of parameters) are defined by the values A1 and A2, respectively.

In the frame t2, the left most column indicates the global parameter(s) GB2, which correspond to the global parameter(s) GB1. The middle column indicates the five parameters D1 to D5 which correspond to the parameters C1 to C5. The frequency ranges associated with GB1 and D1 to D5 are the same as the frequency ranges associated with GB2 and C1 to C5, respectively. The right most column in the frame t2 shows three frequency sub-ranges SFRB1 to SFRB3 and the values B1 to B3 of the associated parameters. The frequency sub-ranges SFRB1 and SFRB2 associated with the values B1 and B2 are identical to the frequency sub-ranges SFRA1 and SFRA2 associated with the values A1 and A2, respectively. The values B1 and B2 are differentially coded with respect to the values A1 and A2, respectively. As, in the frame t1, there is no frequency sub-range corresponding to the frequency sub-range SFRB3 in the frame t2, it is not possible to differentially code the value B3 with respect to a value in the frame t1. Still, a data reduction is possible by coding the value B3 with respect to the global parameter(s) GB2.

Thus, in general, if the number of bins of the parameters with values Ai in a particular frame is smaller than the number of bins of the corresponding parameters with values Bi in the next frame, the differential coding is performed only on bins that actually exist in both frames. Bins that do not have a predecessor are differentially coded with respect to the global values GB2.

FIG. 7 shows a schematic representation of a situation wherein the number of parameters during a first frame is higher than during a second frame.

In the frame t1, the left most column indicates the global parameter(s) GB1 which represent aspects of the audio signal 1 for the total frequency range FR. The adjacent middle column shows five parameters (or sets of parameters, for example IID and/or ICC parameters) which are indicated by C1 to C5. Each one of the parameters (or parameter sets) Ci is relevant for an associated frequency sub-range of the total frequency range FR. The frequency sub-ranges together cover the total frequency range FR. The right most column in the frame t1 shows three frequency sub-ranges SFRA1 to SFRA3 in which three parameters (or sets of parameters) are defined by the values A1 to A3, respectively.

In the frame t2, the left most column indicates the global parameter(s) GB2, which correspond to the global parameter(s) GB1. The middle column indicates the five parameters D1 to D5 which correspond to the parameters C1 to C5. The frequency ranges associated with GB1 and D1 to D5 are the same as the frequency ranges associated with GB2 and C1 to C5, respectively. The right most column in the frame t2 shows two frequency sub-ranges SFRB1 and SFRB2 and the values B1 and B2 of the associated parameters. The frequency sub-ranges SFRB1 and SFRB2 associated with the values B1 and B2 are identical to the frequency sub-ranges SFRA1 and SFRA2 associated with the values A1 and A2. The values B1 and B2 are differentially coded with respect to the values A1 and A2, respectively.

Thus, in general, if the number of bins of the parameters with values Ai in a particular frame is larger than the number of bins of the corresponding parameters with values Bi in the next frame, the differential coding is performed only on bins that actually exist in both frames.

The coding algorithm described with respect to both FIG. 6 and FIG. 7 does not require a signaling in the bit-stream.

For example, in the situation as depicted in FIGS. 6 and 7, the Ai and Bi values may represent the number of ITD bins, in a practical realization the number of ITD bins may vary between 11 to 16.

It should be noted that the above-mentioned embodiments illustrate rather than limit the invention, and that those skilled in the art will be able to design many alternative embodiments without departing from the scope of the appended claims.

For example, the absolute number and the change thereof of parameters in corresponding bins of successive frames are examples only. In a practical situation, the number of bins may depend on the actual audio signal and the quality of the audio to be decoded (or the available maximal bit stream). For example, in the situation as depicted in FIGS. 6 and 7, the Ai and Bi values may represent the number of ITD bins, in a particular practical realization the number of ITD bins may vary between 11 to 16.

In the claims, any reference signs placed between parentheses shall not be construed as limiting the claim. The word "comprising" does not exclude the presence of elements or steps other than those listed in a claim. The invention can be implemented by means of hardware comprising several distinct elements, and by means of a suitably programmed computer. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A method of coding an audio signal, the method comprising acts of:

calculating, using a processor, values of a first number of first parameters representing aspects of the audio signal at a first instant to obtain first calculated values;

calculating, using a processor, values of a second number of second parameters representing the aspects of the audio signal at a second, later, instant to obtain second calculated values, wherein the first number and the second number differ; and coding, using an encoder, a subset of the second parameters being associated with a particular portion of a frequency range of the audio signal based on a difference of a subset of the second calculated value(s) associated with this particular portion of the frequency range and a subset of the first calculated value(s) associated with substantially this particular portion of the frequency range to obtain differentially coded values of the second parameters, wherein the first parameters together and the second parameters together cover substantially the same frequency range, and wherein the number of first parameters is larger than the number of second parameters, the subset of the second calculated value(s) comprises one value for the particular portion of the frequency range being a sub-range of the substantially the same frequency range, the subset of the first parameters comprises at least two first calculated values, the differentially coded value corresponding to the one value being based on the difference of a mean value of the corresponding first calculated values and the one value.

2. The method of coding an audio signal as claimed in claim 1, wherein both the first parameters together and the second parameters together cover substantially the same frequency range, and wherein the number of first parameters is smaller than the number of second parameters, the subset of the first calculated value(s) comprises one value for the particular portion of the frequency range being a sub-range of the substantially the same frequency range, the subset of the second calculated values comprises at least two second calculated values, to each one of the second calculated values corresponds one of the differentially coded values being based on the difference of the corresponding second calculated value and the one value.

3. The method of coding an audio signal as claimed in claim 1, wherein each one of the first parameters and the corresponding one of the second parameters cover substantially the same frequency range, wherein the number of first parameters is larger than the number of second parameters, the subset of the first calculated value(s) comprises a value for each one of the first parameters, the subset of the second calculated values comprises a value for each one of the second parameters, wherein in frequency ranges for which both a first and a second calculated value is calculated, the differentially coded value is based on the difference of the corresponding first and second calculated value, and wherein in frequency ranges for which a first parameter but no second parameter is calculated no coded values have to be determined.

4. The method of coding an audio signal as claimed in claim 1, wherein the mean value is calculated as a weighted sum of the first calculated values with weights.

5. The method of coding an audio signal as claimed in claim 4, wherein the weights are equal to 1/M, wherein M is the number of first parameters which are associated with a frequency sub-range which at least partly overlaps with the particular portion of the frequency range.

6. The method of coding an audio signal as claimed in claim 4, wherein the weights are related to sizes of frequency sub-ranges associated to the corresponding one of the first parameters.

7. The method of coding an audio signal as claimed in claim 4, wherein the weight of a first parameter which is associated with a frequency sub-range which does not completely overlap with the particular portion of the frequency range of the second parameter is decreased.

8. The method of coding an audio signal as claimed in claim 1, comprising an act of transmitting the coded signal.

9. The method of coding an audio signal as claimed in claim 1, comprising an act of storing the calculated values in a memory.

10. An encoder device for coding an audio signal and comprising:

means for calculating values of first parameters representing aspects of the audio signal at a first instant to obtain first calculated values;

means for calculating values of second parameters representing the aspects of the audio signal at a second, later, instant to obtain second calculated values, wherein a number of the first parameters and a number of the second parameters differ; and means for coding a subset of the second parameters being associated with a particular portion of a frequency range of the audio signal based on a difference of a subset of the second calculated value(s) associated with this particular portion of the frequency range and a subset of the first calculated value(s) associated with substantially this particular portion of the frequency range to obtain differentially coded values of the second parameters, wherein the first parameters together and the second parameters together cover substantially the same frequency range, and wherein the number of first parameters is larger than the number of second parameters, the subset of the second calculated value(s) comprises one value for the particular portion of the frequency range being a sub-range of the substantially the same frequency range, the subset of the first parameters comprises at least two first calculated values, the differentially coded value corresponding to the one value being based on the difference of a mean value of the corresponding first calculated values and the one value.

11. An apparatus for supplying an audio signal, the apparatus comprising:

an input for receiving an audio signal;

an encoder for encoding the audio signal to obtain an encoded audio signal, the encoder being configured to:

calculate values of first parameters representing aspects of the audio signal at a first instant to obtain first calculated values, calculate values of second parameters representing the aspects of the audio signal at a second, later, instant to obtain second calculated values, wherein a number of the first parameters and a number of the second parameters differ, and code a subset of the second parameters being associated with a particular portion of a frequency range of the audio signal based on a difference of a subset of the second calculated value(s) associated with this particular portion of the frequency range and a subset of the first calculated value(s) associated with substantially this particular portion of the frequency range to obtain differentially coded values of the second parameters; and an output for supplying the encoded audio signal, wherein the first parameters together and the second parameters together cover substantially the same frequency range, and wherein the number of first parameters is larger than the number of second parameters, the subset of the second calculated value(s) comprises one value for the particular portion of the frequency range being a sub-range of the substantially the same frequency range, the subset of the first parameters comprises at least two first calculated values, the differentially coded value corresponding to the one value being based on the difference or a mean value of the corresponding first calculated values and the one value.

12. A method of coding an audio signal, the method comprising acts of:

calculating, using a processor, values of a first number of first parameters representing aspects of the audio signal at a first instant to obtain first calculated values;

calculating, using a processor, values of a second number of second parameters representing the aspects of the audio signal at a second, later, instant to obtain second calculated values, wherein the first number and the second number differ;

calculating, using a processor, global values for a total frequency range of the audio signal, and wherein each one of the first parameters and the corresponding one of the second parameters cover substantially the same frequency range, wherein the number of the first parameters is smaller than the number of the second parameters, the subset of the first calculated value(s) comprises a value for each one of the first parameters, the subset of the second calculated values comprises a value for each one of the second parameters; and coding, using an encoder, a subset of the second parameters being associated with a particular portion of a frequency range of the audio signal based on a difference of a subset of the second calculated value(s) associated with this particular portion of the frequency range and a subset of the first calculated value(s) associated with substantially this particular portion of the frequency range to obtain differentially coded values of the second parameters, wherein in frequency ranges for which both a first and a second calculated value is calculated, the differentially coded value is based on the difference of the corresponding first and second calculated value, and wherein, in frequency ranges for which a second parameter but no first parameter is calculated, the coded value is based on the difference of the corresponding second parameter and the global values.

13. An encoder device for coding an audio signal and comprising:

means for calculating values of first parameters representing aspects of the audio signal at a first instant to obtain first calculated values;

means for calculating values of second parameters representing the aspects of the audio signal at a second, later, instant to obtain second calculated values, wherein a number of the first parameters and a number of the second parameters differ; and means for coding a subset of the second parameters being associated with a particular portion of a frequency range of the audio signal based on a difference of a subset of the second calculated value(s) associated with this particular portion of the frequency range and a subset of the first calculated value(s) associated with substantially this particular portion of the frequency range to obtain differentially coded values of the second parameters, wherein said encoder further comprises:

means for calculating global values for a total frequency range of the audio signal, and wherein each one of the first parameters and the corresponding one of the second parameters cover substantially the same frequency range, wherein the number of the first second parameters is smaller than the number of the second first parameters, the subset of the first calculated value(s) comprises a value for each one of the first parameters, the subset of the second calculated values comprises a value for each one of the second parameters, wherein in frequency ranges for which both a first and a second calculated value is calculated, the differentially coded value is based on the difference of the corresponding first and second calculated value, and wherein, in frequency ranges for which a second parameter but no first parameter is calculated, the coded value is based on the difference of the corresponding second parameter and the global values.

* * * * *